US009459547B2

(12) United States Patent
Terasaki

(10) Patent No.: US 9,459,547 B2
(45) Date of Patent: Oct. 4, 2016

(54) CAPSULE TONER FOR DEVELOPING ELECTROSTATIC CHARGE IMAGE AND METHOD OF MANUFACTURING THE SAME

(71) Applicant: KYOCERA Document Solutions Inc., Osaka (JP)

(72) Inventor: Kohei Terasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/606,325

(22) Filed: Jan. 27, 2015

(65) Prior Publication Data

US 2015/0212445 A1 Jul. 30, 2015

(30) Foreign Application Priority Data

Jan. 30, 2014 (JP) ..... 2014-015068

(51) Int. Cl.

| | |
|---|---|
| ***G03G 9/00*** | (2006.01) |
| ***G03G 9/093*** | (2006.01) |
| ***G03G 9/087*** | (2006.01) |
| ***G03G 9/08*** | (2006.01) |

(52) U.S. Cl.

CPC ..... *G03G 9/09328* (2013.01); *G03G 9/0827* (2013.01); *G03G 9/08755* (2013.01); *G03G 9/09392* (2013.01)

(58) Field of Classification Search

CPC ..... G03G 9/09328; G03G 9/0827; G03G 9/09392

USPC ..... 430/110.2, 137.11

See application file for complete search history.

(56) References Cited

U.S. PATENT DOCUMENTS

| | | | | |
|---|---|---|---|---|
| 8,017,292 | B2 | 9/2011 | Sabu et al. | |
| 9,034,550 | B2 | 5/2015 | Mizoguchi et al. | |
| 2005/0027196 | A1 | 2/2005 | Fitzgerald | |
| 2005/0058927 | A1 * | 3/2005 | Mikuriya ..... | G03G 9/0825 430/110.2 |
| 2005/0271964 | A1 | 12/2005 | Etou et al. | |
| 2008/0280218 | A1 | 11/2008 | Sabu et al. | |
| 2013/0236828 | A1 | 9/2013 | Mizoguchi et al. | |

FOREIGN PATENT DOCUMENTS

| | | | |
|---|---|---|---|
| JP | 2002-148858 | A | 5/2002 |
| JP | 2004-138985 | A | 5/2004 |
| JP | 2004-294468 | A | 10/2004 |
| JP | 2004294469 | A | 10/2004 |
| JP | 2008-281882 | A | 11/2008 |
| JP | 2009-237110 | A | 10/2009 |
| JP | 2012-128404 | A | 7/2012 |

OTHER PUBLICATIONS

An Office Action; "Notification of Reasons for Refusal" issued by the Japanese Patent Office on Aug. 2, 2016, which corresponds to Japanese Patent Application No. 2014-015068 and is related to U.S. Appl. No. 14/606,325; with English language translation.

* cited by examiner

*Primary Examiner* — Thorl Chea

(74) *Attorney, Agent, or Firm* — Studebaker & Brackett PC

(57) ABSTRACT

A capsule toner for developing an electrostatic charge image includes a plurality of toner particles. Each of the toner particles includes a core and a shell layer disposed over a surface of the core. The cores have a zeta potential at pH 4 of less than 0 V, and the toner particles have a zeta potential at pH 4 of greater than 0 V. The shell layers have a hardness of at least 1 $N/m^2$ and less than 3 $N/m^2$. The shell layers have a thickness of no greater than 20 nm. The toner particles have a roundness of at least 0.965 and less than 0.975.

12 Claims, No Drawings

CAPSULE TONER FOR DEVELOPING ELECTROSTATIC CHARGE IMAGE AND METHOD OF MANUFACTURING THE SAME

INCORPORATION BY REFERENCE

The present application claims priority under 35 U.S.C. §119 to Japanese Patent Application No. 2014-015068, filed Jan. 30, 2014. The contents of this application are incorporated herein by reference in their entirety.

BACKGROUND

The present disclosure relates to a capsule toner for developing an electrostatic charge image and a method of manufacturing the capsule toner.

Toner particles of a capsule toner each include a core and a shell layer disposed over a surface of the core. One known method of manufacturing a capsule toner involves forming shell layers over a surface of cores dispersed in the solid phase in an aqueous medium containing a dispersant dissolved therein.

SUMMARY

According to the present disclosure, a capsule toner for developing an electrostatic charge image includes a plurality of toner particles. Each of the toner particles includes a core and a shell layer disposed over a surface of the core. The cores have a zeta potential at pH 4 of less than 0 V, and the toner particles have a zeta potential at pH 4 of greater than 0 V. The shell layers have a hardness of at least 1 $N/m^2$ and less than 3 $N/m^2$. The shell layers have a thickness of no greater than 20 nm. The toner particles have a roundness of at least 0.965 and less than 0.975.

According to the present disclosure, a method of manufacturing a capsule toner for developing an electrostatic charge image is directed to manufacture of a capsule toner according to the present disclosure. The method involves preparing a material, adding the material, and causing a reaction of the material. In the preparing a material, cores are prepared. In the adding the material, the cores and a water-soluble shell material are added to an aqueous medium. In the causing the reaction of the material, a shell layer is formed over a surface of each of the cores by causing a polymerization reaction of the shell material in the aqueous medium having a pH of at least 3 and no greater than 5.

DETAILED DESCRIPTION

An embodiment of the present disclosure will be explained below. However, the present disclosure is not limited to the embodiment explained below.

A toner according to the present embodiment is a capsule toner for developing an electrostatic charge image. For example, the toner according to the present embodiment is suitable for use as a positively chargeable toner for developing an electrostatic charge image. The toner according to the present embodiment is a powder that includes a large number of toner particles (each having properties described below).

Each toner particle includes a core (hereinafter, referred to as a toner core) and a shell layer (capsule film) disposed over a surface of the toner core. An external additive may adhere to a surface of the shell layer. The shell layer is not limited to a single-layer film and may be a multi-layer film. Note that the external additive may be omitted if unnecessary. In the following explanation, toner particles prior to the adhesion of an external additive are referred to as toner mother particles. In addition, a material for forming shell layers is referred to as a shell material.

The toner according to the present embodiment has the following properties (1) to (3).

(1) The toner cores have a zeta potential at pH 4 of less than 0 V (negative value), and the toner particles have a zeta potential at pH 4 of greater than 0 V (positive value).

(2) The shell layers have a hardness of at least 1 $N/m^2$ and less than 3 $N/m^2$ and a thickness of no greater than 20 nm.

(3) The toner particles have a roundness of at least 0.965 and less than 0.975.

With respect to the property (1), a zeta potential of toner cores or toner particles at pH 4 refers to a zeta potential measured in an aqueous medium adjusted to pH 4. The zeta potential at pH 4 is measured in a state where the particles (toner cores or toner particles) are dispersed in an aqueous medium adjusted to pH 4. Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of charged particles in the dispersion and measuring the zeta potential based on the rate of electrophoresis. An example of the electrophoresis method is laser Doppler electrophoresis in which migrating particles are irradiated with laser light and the rate of electrophoresis of the particles is calculated from an amount of Doppler shift of scattered light that is obtained. The laser Doppler electrophoresis is advantageous in that the particle concentration in the dispersion needs not be high, the number of parameters necessary for calculating the zeta potential is not large, and the rate of electrophoresis of the particles is detected with high sensitivity.

The ultrasound method involves irradiating a liquid dispersion of particles with ultrasound, thereby causing electrically charged particles in the dispersion to vibrate, and calculating the zeta potential based on an electric potential difference that arises due to the vibration.

The ESA method involves applying a high-frequency voltage to a liquid dispersion of particles, thereby causing electrically charged particles in the dispersion to vibrate and generate ultrasound. The zeta potential is then measured based on the magnitude (intensity) of the ultrasound.

The ultrasound method and ESA method are advantageous in that the zeta potential can be measured with high sensitivity even when the concentration of the particles in the dispersion is high (for example, exceeding 20% by mass).

The action and effect of the property (1) has been empirically identified. More specifically, the present inventor prepared toners each by adding toner cores and a shell material to an aqueous medium and forming shell layers over the surface of the toner cores in the aqueous medium. The present inventor then examined the resultant toners for the fixability and high-temperature preservability in relation to the pH of the aqueous medium, the zeta potential of the toner cores, and the zeta potential of the toner particles. With the aqueous medium having a pH of less than 3 or greater than 5, the resultant toner exhibited no apparent relation between the zeta potential of the particles and the properties of the toner. Yet, with the aqueous medium having pH 4, the following has been empirically identified. That is, the fixability and high-temperature preservability of the resultant toner tend to improve by adjusting the zeta potential of the toner cores to be less than 0 V and the zeta potential of the toner particles to exceed 0 V. For the toner cores to be stably anionic, the zeta potential of the toner cores at pH 4 is preferably no greater than −4 mV, and more preferably no greater than −10 mV. For the toner particles to be stably cationic, the zeta potential of the toner particles at pH 4 is preferably at least 15 mV, and preferably at least 25 mV.

To manufacture a toner having the property (1), the toner cores are preferably anionic and the shell material is preferably cationic in an aqueous medium having a pH of at least 3 and no greater than 5. With the toner cores being anionic, the cationic shell material can be electrically attracted toward the surface of the toner cores during formation of the shell layers. More specifically, the shell material which has a positive charge in the aqueous medium is attracted toward the toner cores which have a negative charge in the aqueous medium, forming the shell layers over the surface of the toner cores. As a consequence, uniform shell layers can be readily formed over the surface of the toner cores without needing to use a dispersant in order to highly disperse the toner cores in the aqueous medium.

With respect to the property (2), the hardness and thickness of shell layers are measured according to the following method or its alternative method.

<Method of Measuring Shell Layer Hardness>

An atomic force microscope (AFM) is used to press the shell layer of a toner particle included in a sample (toner) with an AFM needle and measure the pressing force acting on the AFM needle at the moment of the shell layer rupturing. The pressing force thus measured is determined as an evaluation value (shell layer hardness).

<Method of Measuring Shell Layer Thickness>

A sample (toner) is dispersed in a cold-setting epoxy resin and left to stand for 2 days in a 40° C. atmosphere to obtain a hardened material. The resultant hardened material is dyed in osmium tetroxide and subsequently a flake sample is cut therefrom at a thickness of 200 nm by using an ultramicrotome (for example, EM UC6, product of Leica Microsystems) equipped with a diamond knife. Next, with a transmission electron microscope (TEM) (for example, JSM-6700F, product of JEOL Ltd.), a TEM image of a cross-section of the flake sample is captured.

The shell layer thickness is measured by analyzing the TEM image using image analysis software (for example, WinROOF, product of Mitani Corporation). More specifically, two straight lines are drawn to intersect at right angles at approximately the center of the cross-section of a toner particle targeted for measurement, and the length of each of four line segment crossing the shell layer is measured. The shell layer thickness of the toner particle is determined to be the arithmetic mean of the four lengths that are measured. The shell layer thickness is measured for 10 or more toner particles of the sample (toner), and the arithmetic mean of the 10 or more measurement values is determined to be an evaluation value (shell layer thickness).

When the shell layer is excessively thin, the TEM image may not clearly depict a boundary between the toner core and the shell layer, complicating measurement of thickness of the shell layer. In such a situation, the thickness of the shell layer is measured by using TEM and electron energy loss spectroscopy (EELS) in combination in order to clarify the boundary between the toner core and the shell layer. More specifically, in the captured TEM image, mapping is performed by EELS for a specific element (for example, nitrogen) contained in the shell layer.

The action and effect of the property (2) has been empirically identified. More specifically, when shell layers are too thin, the high-temperature preservability and cleanability (more specifically, the resistance against stress applied during toner cleaning) of the toner tends to decrease. On the other hand, when shell layers are too thick, the minimum fixing temperature of the toner tends to be higher. The present inventor has found that a toner that is excellent in minimum fixing temperature, high-temperature preservability, and cleanability can be obtained by ensuring the shell layers to have a thickness of no greater than 20 nm and a hardness of at least 1 $N/m^2$ and less than 3 $N/m^2$. For the toner to stably exhibit the excellent characteristics, the shell layers preferably have a hardness of at least 1.5 $N/m^2$ and less than 2.5 $N/m^2$.

With respect to the property (3), the roundness of toner particles are measured according to the following method or its alternative method.

<Method of Measuring Toner Particle Roundness>

A flow particle imaging analyzer (for example, FPIA (registered Japanese trademark)-3000, product of Sysmex Corporation) is used to measure the roundness of each of 3,000 toner particles of a sample (toner), and the number average of 3,000 measurement values is determined to be an evaluation value (toner particle roundness) of the sample (toner).

The action and effect of the property (3) has been empirically identified. More specifically, when the roundness of the toner particles is too high, a greater amount of toner particles tend to escape through a gap between a photosensitive drum and a cleaning blade. On the other hand, when the roundness of the toner particles is too low, the adhesion of the shell material to the surface of the toner cores increases, thereby decreasing the developability of the toner. The present inventor has found that ensuring the toner particles to have a roundness of at least 0.965 and less than 0.975 is effective to restrict both the escape of toner particles through a gap between the photosensitive drum and the cleaning blade and the decrease in the toner developability. The roundness of the toner particles can be adjusted by controlling, for example, the shell layer hardness and the polymerization time of the shell material. When the shell layers contain a thermoplastic resin, the roundness of toner particles tends to be higher due to the influence of heat associated with the polymerization reaction of the shell material.

The following sequentially explains the toner cores (binder resin and internal additive), shell layers, and an external additive. Note that the term (meth)acrylic may be used as a generic term for both acrylic and methacrylic.

[Toner Cores]

The toner cores contain a binder resin. The toner cores may contain one or more internal additives (a colorant, a releasing agent, a charge control agent, and/or a magnetic powder). However, non-essential components (for example, any of the colorant, releasing agent, charge control agent, and magnetic powder) may be omitted in accordance with intended use of the toner.

[Binder Resin (Toner Cores)]

A binder resin often constitutes a large portion (for example, at least 85% by mass) of components contained in the toner cores. Therefore, the polarity of the binder resin is presumed to have a significant influence on the overall polarity of the toner cores. For example, when the binder resin has an ester group, a hydroxyl group, an ether group, an acid group, or a methyl group, the toner cores tend to be anionic. On the other hand, when the binder resin has an amino group, an amine, or an amide group, the toner cores tend to be cationic.

For the binder resin to be strongly anionic, the hydroxyl value (measured according to Japanese Industrial Standard (JIS) K-0070) and the acid value (measured according to JIS K-0070) the binder resin are both preferably at least 10 mg KOH/g, and more preferably at least 20 mg KOH/g.

The binder resin preferably has a functional group such as an ester group, a hydroxyl group, an ether group, an acid group, a methyl group, or a carboxyl group in molecules thereof, and more preferably has either or both of a hydroxyl group and a carboxyl group in molecules thereof. The toner cores (binder resin) having a functional group such as above readily react with the shell material (for example, methylol melamine) to form chemical bonds. Such chemical bonding causes each toner core to be firmly attached to a shell layer.

The binder resin is preferably a thermoplastic resin. Preferable examples of thermoplastic resins that can be used as the binder resin include styrene-based resins, acrylic-based resins, styrene-acrylic-based resins, polyethylene-based resins, polypropylene-based resins, vinyl chloride-based resins, polyester resins, polyamide resins, urethane resins, polyvinyl alcohol-based resins, vinyl ether-based resins, N-vinyl-based resins, and styrene-butadiene based resins. Among the examples listed above, styrene-acrylic-based resins and polyester resins are preferable for improving colorant dispersibility in the toner, chargeability of the toner, and fixability of the toner to a recording medium.

A styrene-acrylic-based resin is a copolymer of a styrene-based monomer and an acrylic-based monomer.

Preferable examples of styrene-based monomers that can be used in preparation of the styrene-acrylic-based resin (binder resin) include styrene, α-methylstyrene, p-hydroxystyrene, m-hydroxystyrene, vinyltoluene, α-chlorostyrene, o-chlorostyrene, m-chlorostyrene, p-chlorostyrene, p-ethylstyrene, and so on.

Preferable examples of acrylic-based monomers that can be used in preparation of the styrene-acrylic-based resin (binder resin) include (meth)acrylic acid, alkyl (meth)acrylates, hydroxyalkyl (meth)acrylates, and so on. Preferable examples of alkyl esters of (meth)acrylic acid include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Preferable examples of hydroxyalkyl (meth)acrylates include 2-hydroxyethyl (meth)acrylate, 3-hydroxypropyl (meth)acrylate, 2-hydroxypropyl (meth) acrylate, and 4-hydroxybutyl (meth)acrylate.

A hydroxyl group can be introduced into the styrene-acrylic-based resin by using a hydroxyl group-containing monomer (for example, p-hydroxystyrene, m-hydroxystyrene, or hydroxyalkyl (meth)acrylate) during preparation of the styrene-acrylic-based resin. The hydroxyl value of the styrene-acrylic-based resin to be obtained can be adjusted by, for example, appropriately adjusting the amount of the hydroxyl group-containing monomer used.

A carboxyl group can be introduced into the styrene-acrylic-based resin by using (meth)acrylic acid (monomer) during preparation of the styrene-acrylic-based resin. The acid value of the styrene-acrylic-based resin to be obtained can be adjusted by, for example, adjusting the amount of the (meth)acrylic acid used.

When the binder resin is a styrene-acrylic-based resin, the number average molecular weight (Mn) of the styrene-acrylic-based resin is preferably at least 2,000 and no greater than 3,000 in order to improve the strength of the toner cores and the fixability of the toner. The molecular weight distribution (i.e., a ratio Mw/Mn of mass average molecular weight (Mw) relative to number average molecular weight (Mn)) of the styrene-acrylic-based resin is preferably at least 10 and no greater than 20. Mn and Mw of the styrene-acrylic-based resin can be measured by gel permeation chromatography.

The polyester resin used as the binder resin is prepared through condensation polymerization or condensation copolymerization of a di-, tri-, or higher-hydric alcohol and a di-, tri-, or higher-basic carboxylic acid, for example.

When the binder resin is a polyester resin, preferable examples of alcohols that can be used in preparation of the polyester resin include diols, bisphenols, and tri- or higher hydric alcohols as listed below.

Preferable examples of diols that can be used in preparation of the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used in preparation of the polyester resin include bisphenol A, hydrogenated bisphenol A, polyoxyethylenated bisphenol A, and polyoxypropylenated bisphenol A.

Preferable examples of tri- or higher-hydric alcohols that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin is a polyester resin, preferable examples of carboxylic acids that can be used in preparation of the polyester resin include di-, tri-, and higher-basic carboxylic acids as listed below.

Preferable examples of di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butylsuccinic acid, isobutylsuccinic acid, n-octylsuccinic acid, n-dodecylsuccinic acid, isododecylsuccinic acid, and the like), and alkenyl succinic acids (more specifically, n-butenylsuccinic acid, isobutenylsuccinic acid, n-octenylsuccinic acid, n-dodecenylsuccinic acid, isododecenylsuccinic acid, and the like).

Preferable examples of tri- or higher-basic carboxylic acids that can be used in preparation of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

An ester-forming derivative (acid halide, acid anhydride, or lower alkyl ester) of any of the di-, tri-, or higher-basic carboxylic acids listed above may be used. Herein, the term lower alkyl refers to an alkyl group having 1 to 6 carbon atoms.

The acid value and the hydroxyl value of the polyester resin can be adjusted through adjustment of the amount of the di-, tri-, or higher-hydric alcohol and the amount of the di-, tri-, or higher-basic carboxylic acid used during preparation of the polyester resin. Note that increasing the molecular weight of the polyester resin tends to decrease the acid value and the hydroxyl value of the polyester resin.

When the binder resin is a polyester resin, the number average molecular weight (Mn) of the polyester resin is preferably at least 1,200 and no greater than 2,000 in order to improve the strength of the toner cores and the fixability of the toner. The molecular weight distribution (i.e., a ratio Mw/Mn of mass average molecular weight (Mw) relative to number average molecular weight (Mn)) of the polyester resin is preferably at least 9 and no greater than 20. Mn and Mw of the polyester resin can be measured by gel permeation chromatography.

The binder resin preferably has a solubility parameter (SP value) of at least 10, and more preferably at least 15. When the SP value of the binder resin is at least 10, affinity of the binder resin for water improves due to the SP value of the binder resin being closer to the SP value of water (which is 23). Consequently, the wettability of the binder resin to an aqueous medium increases. The improved wettability of the binder resin to an aqueous medium facilitates fine particle of the binder resin to be dispersed homogeneously in an aqueous medium without a dispersant.

The glass transition point (Tg) of the binder resin is preferably no greater than a curing initiation temperature of the shell material. With the use of a binder resin having such a Tg, the toner is presumed to be easily fixed at low temperatures even during high-speed fixing. In an acidic aqueous medium having pH of no greater than 4, a thermal curing reaction to synthesize a melamine resin (a reaction of melamine monomers) typically occurs rapidly at 50° C. or higher. When the shell layers contain a melamine resin, Tg of the binder resin is preferably close to a reaction temperature (50° C.) of melamine monomers. More specifically, Tg of the binder resin is preferably at least 20° C. and no greater than 55° C., and more preferably at least 30° C. and no greater than 50° C. With the binder resin having Tg of at least 20° C., the toner cores are less prone to aggregate during formation of the shell layers.

The glass transition point (Tg) of the binder resin can be measured according to the method explained below. The heat absorption curve of the binder resin can be obtained by using a differential scanning calorimeter (for example, DSC-6220, product of Seiko Instruments Inc.). The glass transition point (Tg) of the binder resin can be calculated from the heat absorption curve (more specifically, from a point of change of specific heat of the binder resin). More specifically, a 10 mg measurement sample (binder resin) is first placed in an aluminum pan. Next, a heat absorption curve is plotted for the binder resin, using an empty aluminum pan as a reference, under conditions of a measurement temperature range from 25° C. to 200° C. and a heating rate of 10° C./minute. The glass transition point (Tg) of the binder resin is calculated from the heat absorption curve that is plotted.

The softening point (Tm) of the binder resin is preferably no greater than 100° C. and more preferably no greater than 95° C. With the binder resin having Tm of no greater than 100° C. (more preferably no greater than 95° C.), the toner is presumed to be easily fixed at low temperatures even during high-speed fixing. Note that Tm of the binder resin may be adjusted by combining a plurality of resins each having a different Tm.

The softening point (Tm) of the binder resin can be measured according to the method explained below. For example, a measurement sample (binder resin) is placed in a capillary rheometer (for example, CFT-500D, product of Shimadzu Corporation) and melt-flow of the measurement sample is caused under specific conditions in order to plot an S-shaped curve of stroke (mm)/temperature (° C.). Then, the softening point (Tm) of the binder resin is read from the S-shaped curve thus plotted.

[Colorant (Toner Cores)]

The toner cores may for example contain a colorant as an internal additive. The colorant may be a commonly known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

(Black Colorant)

The toner cores may contain a black colorant. Examples of the black colorant include carbon black. In another example, a colorant may be used that has been adjusted to a black color using colorants such as a yellow colorant, a magenta colorant, and a cyan colorant.

(Non-Black Colorants)

The toner cores may contain a non-black colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Preferable examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, copper phthalocyanine derivatives, anthraquinone compounds, and basic dye lake compounds. Preferable examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

[Releasing Agent (Toner Cores)]

The toner cores may contain a releasing agent as an internal additive. The releasing agent is for example used in order to improve fixability or offset resistance of the toner. In order to improve fixability or offset resistance of the toner, the amount of the releasing agent is preferably at least 1 part by mass and no greater than 30 parts by mass relative to 100 parts by mass of the binder resin, and more preferably at least 5 parts by mass and no greater than 20 parts by mass.

Preferable examples of the releasing agent include: aliphatic hydrocarbon-based waxes, such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes, such as polyethylene oxide wax and block copolymer thereof; plant waxes, such as candelilla wax, carnauba wax, Japan wax, jojoba wax, and rice wax; animal waxes, such as beeswax, lanolin, and spermaceti; mineral waxes, such as ozocerite, ceresin, and petrolatum; waxes having a fatty acid ester as major component, such as montanic acid ester wax, and castor wax; and waxes in which a part or all of a fatty acid ester has been deoxidized, such as deoxidized carnauba wax.

[Charge Control Agent (Toner Cores)]

The toner cores may contain a charge control agent as an internal additive. The charge control agent is for example used in order to improve charge stability or a charge rise characteristic of the toner. The charge rise characteristic serves as an indicator of whether or not the toner can be charged to a specific charge level in a short period of time. When the toner cores are anionic, the presence of a negatively chargeable charge control agent in the toner cores can enhance the anion nature of the toner cores.

[Magnetic Powder (Toner Cores)]

The toner cores may contain a magnetic powder as an internal additive. When the toner is used as a one-component developer, the amount of the magnetic powder is preferably at least 35 parts by mass and no greater than 60 parts by mass relative to 100 parts by mass of the toner, and more preferably at least 40 parts by mass and no greater than 60 parts by mass.

Preferable examples of a material of the magnetic powder include iron (more specifically, ferrite, magnetite, and the like), ferromagnetic metals (more specifically, cobalt, nickel, and the like), alloys containing either or both of iron and a ferromagnetic metal, ferromagnetic alloys subjected to ferromagnetization (for example, heat treatment), and chromium dioxide.

In order to homogeneously disperse the magnetic powder in the binder resin, the number average primary particle diameter of the magnetic powder is preferably at least 0.1 μm and no greater than 1.0 μm, and more preferably at least 0.1 μm and no greater than 0.5 μm.

[Shell Layers]

The shell layers may consist essentially of a thermosetting resin, may consist essentially of a thermoplastic resin, or may contain both a thermosetting resin and a thermoplastic resin. In order to improve the high-temperature preservability of the toner, the shell layers preferably contain a thermosetting resin, and more preferably consist essentially of a thermosetting resin. In order to improve the high-temperature preservability of a positively chargeable toner, the shell layers preferably contain at least one resin selected from the group consisting of a melamine resin, a urea resin, and a glyoxal resin. In order to improve the high-temperature preservability of a toner, in addition, at least 80% by mass, more preferably at least 90% by mass, and particularly preferably 100% by mass of the resin contained in the shell layers is a thermosetting resin.

The following explains preferable examples of resins that can be contained in the shell layers. Note that the shell layers may contain derivatives of the resins listed below as necessary.

To enhance the cationic nature of the shell layers, the shell layers preferably contain a nitrogen-containing resin. A nitrogen-containing material is readily charged to a positive charge. One preferable example of a thermosetting resin containing nitrogen atoms is a resin having an amino group (—$NH_2$). Preferable examples of thermosetting resins having an amino group include a melamine resin, a urea resin, a sulfonamide resin, a glyoxal resin, a guanamine resin, an aniline resin, and a polyimide resin. A polyimide resin contains nitrogen in a molecular backbone thereof. Therefore, shell layers containing a polyimide resin tend to be strongly cationic. Preferable examples of the polyimide resins that may be contained in the shell layers include maleimide-based polymers and bismaleimide-based polymers (more specifically, amino-bismaleimide polymers, bismaleimide triazine polymers, and the like). The thermosetting resin contained in the shell layers may be a resin not containing nitrogen atoms (for example, epoxy resin or xylene resin).

The thermosetting resin contained in the shell layers is preferably a resin having a methylene group (—$CH_2$—) derived from an aldehyde (for example, formaldehyde), and more preferably a resin produced through polycondensation of an aldehyde (for example, formaldehyde) and a compound having an amino group (hereinafter, such a resin is referred to as an aminoaldehyde resin. Examples of aminoaldehyde resins include melamine formaldehyde resins, urea formaldehyde resins, and melamine urea aldehyde resins.

When the toner cores are anionic, the shell material preferably is cationic. The cationic shell material is electrically attracted to the anionic toner cores, tending to adhere to the surface of the toner cores. Examples of cationic shell materials include a monomer or prepolymer having an amino group (—$NH_2$). The thermosetting resin contained in the shell layers can be prepared using at least one thermosetting monomer selected from the group consisting of methylol melamine, melamine, methylol urea (for example, dimethylol dihydroxyethyleneurea), urea, benzoguanamine, acetoguanamine, and spiroguanamine. For the shell material to be appropriately adsorbed onto the surface of anionic toner cores in an aqueous medium and to maintain the dispersion stability to restrict aggregation of toner cores until a curing reaction of the shell layers completes, a melamine-formaldehyde initial condensate is preferable as the shell material. The melamine-formaldehyde initial condensate tends to be appropriately adsorbed onto the surface of the aniconic toner cores in an aqueous medium. The toner cores having a melamine-formaldehyde initial condensate appropriately adsorbed onto the surface thereof tend to have an appropriate affinity for an aqueous medium. The toner cores having an appropriate affinity for an aqueous medium is expected to stably disperse in the aqueous medium and less prone to aggregation. In addition, when the shell material (for example, a melamine-formaldehyde initial condensate) is appropriately adsorbed onto the surface of the toner cores and bonded to a functional group (for example, hydroxyl group or carboxyl group) at the surface of the toner cores, in-situ polymerization reaction on the surface of the toner cores is assumed to be facilitated.

The melamine-formaldehyde initial condensate can, for example, be synthesized by methylolation of melamine through reaction with formaldehyde in methanol, followed by methylation of the resultant methylol melamine. Note that melamine-formaldehyde initial condensates differing in composition ratio of methylol group (—$CH_2OH$), methoxy group (—$OCH_3$), methylene group (—$CH_2$—), and imino group (—NH—) can be produced by changing the amount of formaldehyde and the concentration of methanol. With a decreasing content of imino group in the melamine-formaldehyde initial condensate, the curing temperature of the melamine-formaldehyde initial condensate tends to be higher. The content of methylene group in the melamine-formaldehyde initial condensate corresponds to the condensation degree of the melamine-formaldehyde initial condensate. With a decreasing content of methylene group in the melamine-formaldehyde initial condensate, the concentration of the melamine-formaldehyde initial condensate can be made higher, allowing formation of shell layers having a higher degree of cross-linking. By reducing the content of methylol group in the melamine-formaldehyde initial condensate, a composition containing the melamine-formaldehyde initial condensate can be stabilized and generation of formaldehyde during processing can be restricted.

[Charge Control Agent (Shell Layers)]

The shell layers may contain a charge control agent. When the shell layers are cationic, the presence of a positively chargeable charge control agent in the shell layers can enhance the cationic nature of the shell layers.

[External Additive]

The external additive is used, for example, in order to improve the fluidity or handleability of the toner. In order to improve the fluidity or handleability of the toner, the amount of the external additive is preferably at least 0.5 parts by mass and no greater than 10 parts by mass relative to 100 parts by mass of the toner mother particles, and more preferably at least 2 parts by mass and no greater than 5 parts by mass.

The external additive is for example composed of particles of silica or particles of a metal oxide (for example, alumina, titanium oxide, magnesium oxide, zinc oxide, strontium titanate, barium titanate, or the like).

In order to improve the fluidity or handleability of the toner, the external additive preferably has a number average particle diameter of at least 0.01 μm and no greater than 1 μm.

[Developer]

The toner according to the present embodiment may be used as a one-component developer. Alternatively, the toner may be mixed with a carrier using a mixer (for example, a ball mill) to prepare a two-component developer. In order to restrict scattering of the toner and to form high-quality images, the amount of the toner in a two-component developer is preferably at least 3% by mass and no greater than 20% by mass, and more preferably at least 5% by mass and no greater than 15% by mass.

(Carrier)

As a developer carrier, a magnetic carrier is preferable. For example, carrier is a powder including a large number of carrier particles. For example, each carrier particle includes a carrier core and a coat layer covering the carrier core. Preferably, the coat layers are mainly formed from a resin. The resin forming the coat layers may contain magnetic particles dispersed therein.

Examples of carrier core materials include: metals, such as iron, oxidized iron, reduced iron, magnetite, copper, silicon steel, ferrite, nickel, and cobalt; alloys of any one of the aforementioned metals and one or more of metals including copper, nickel, cobalt, manganese, zinc, and aluminum; ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; and high-dielectric substances, such as ammonium dihydrogen phosphate, potassium dihydrogen phosphate, and Rochelle salt.

Examples of materials for coat layers covering the carrier cores include acrylic-based polymers (more specifically, acrylate polymers, methacrylate polymers, and the like), styrene-based polymers, styrene-acrylic-based polymers, olefin-based polymers (more specifically, polyethylene, chlorinated polyethylene, polypropylene, and the like), polyvinyl chloride, polyvinyl acetate, polycarbonates, cellulose resins, polyester resins, unsaturated polyester resins, polyamide resins, urethane resins, epoxy resins, silicone resins, fluororesins (more specifically, polytetrafluoroethylene, polychlorotrifluoroethylene, polyvinylidene fluoride, and the like), phenolic resins, xylene resins, diallyl phthalate resins, polyacetal resins, and amino resins.

In order to improve the magnetic properties and fluidity of the carrier, the number average primary particle diameter of the carrier as measured through observation using an electron microscope is preferably at least 20 μm and no greater than 120 μm, and more preferably at least 25 μm and no greater than 80 μm.

[Toner Manufacturing Method]

The following explains a method of manufacturing a toner having the above-explained properties according to the present embodiment. First, toner cores are prepared. Subsequently, the toner cores and a shell material are put into a liquid. Preferably, the shell material is subsequently dissolved in the liquid by, for example, stirring the liquid. Then, the shell material is caused to undergo a polymerization reaction in the liquid to form shell layers (hardened films) over the surface of the respective toner cores. To accelerate the polymerization reaction of the shell material, the pH of the liquid during the polymerization reaction is preferably adjusted to at least 3 and no greater than 5. To restrict dissolution or elution of the toner core components (especially, binder resin and releasing agent) during formation of the shell layers, the shell layers are formed preferably in an aqueous medium (water, methanol, ethanol, or the like). Therefore, the use of a water-soluble shell material is preferable. In order to form shell layers containing a melamine resin or a urea resin, the toner cores are preferably put into a solvent containing a methylolated product (for example, methylol melamine or methylol urea) such that the melamine or urea resin is formed into films over the surface of the toner cores.

(Production of Toner Cores)

Preferable examples of a production method of the toner cores include a pulverization and classification method and an aggregation method. These methods facilitate an internal additive to be sufficiently dispersed in a binder resin.

In one example of the pulverization method, first, a binder resin, a colorant, a charge control agent, and a releasing agent are mixed to obtain a mixture. Subsequently, the resultant mixture is melt-knead by using a melt-kneading device (for example, a one- or two-screw extruder) to obtain a melt knead. Subsequently, the resultant melt knead is pulverized and classified. Through the above, toner cores having a desired particle diameter are obtained. The pulverization and classification method can produce toner cores more easily than the aggregation method.

In one example of the aggregation method, first, fine particles of a binder resin, a releasing agent, and a colorant are put into an aqueous medium and the fine particles are caused to aggregate into particles of a desired diameter. Through the above, aggregated particles containing the binder resin, releasing agent, and colorant are obtained. Subsequently, the resultant aggregated particles are heated to cause the components contained in the aggregated particles to coalesce. As a result, the toner cores having a desired particle size are obtained.

(Shell Layer Formation)

In order to form shell layers, first, the pH of a solvent (aqueous medium) is adjusted. The pH is preferably adjusted to the order of 4 through addition of an acid substance, for example. Adjusting the aqueous medium to an acidic pH on the order of 4 accelerates a polymerization reaction of the shell material. Subsequently, a solution of a cationic shell material (hereinafter, referred to as a shell material liquid) is added to the pH-adjusted aqueous medium to dissolve the shell material in the aqueous medium.

When the shell material liquid is added to the aqueous medium, the miscibility of the shell material liquid with the aqueous medium is preferably at least 250% by mass and no greater than 1,000% by mass. When the miscibility of the shell material liquid with the aqueous medium is at least 250% by mass and no greater than 1,000% by mass, the shell material liquid will have an appropriate level of affinity for the aqueous medium. During the formation of the shell layers, this ensures the shell material (for example, melamine-formaldehyde initial condensate) to bond firmly to the surface of the toner cores while the toner cores are kept highly dispersed. Note that the miscibility of the shell material liquid with the aqueous medium indicates the solubility of the shell material liquid (for example, alcohol solution of a melamine-formaldehyde initial condensate). For example, when the miscibility of the shell material liquid with the aqueous medium is 600% by mass, the aqueous medium of up to 6 times (mass ratio) the shell material liquid is miscible with the shell material liquid.

The miscibility of the shell material liquid with the aqueous medium can be adjusted by changing the polymerization degree of the shell material. The miscibility of the shell material liquid with the aqueous medium tends to be lower with an increasing polymerization degree of the shell material. For example, when the shell material is a melamine-formaldehyde initial condensate, the miscibility of the shell material liquid with the aqueous medium can be adjusted by changing the conditions for causing a methylation reaction yielding the melamine-formaldehyde initial condensate. By adjusting the conditions for the methylation reaction (for example, temperature, time, type of acid catalyst, and/or pH), a condensation reaction can proceed simultaneously with the methylation reaction. In addition, the use of a strong acid catalyst in synthesis of a melamine-formaldehyde initial condensate accelerates a cross-linking reaction as compared with the synthesis using a weak acid catalyst. The polymerization degree of the melamine-formaldehyde initial condensate increases as the condensation or cross-linking reaction proceeds.

Subsequently, the toner cores produced according to the method explained above is added to and dispersed in a solvent containing the shell material. Homogeneously dispersing the toner cores in the solvent facilitates formation of uniform shell layers over the surface of the toner cores.

One preferable example of a method for sufficiently dispersing the toner cores employs a device (for example, Hivis Disper Mix, product of PRIMIX Corporation) capable of vigorously stirring the solvent. However, the above is not a limitation and the toner cores may be dispersed according to any appropriate method.

The toner cores may be dispersed in an aqueous medium containing a dispersant. However, when the content of the dispersant is too high, the curing reaction of the shell layers proceeds with the dispersant adhering to the surface of the toner cores. In such a case, the presence of the dispersant between the toner cores and the shell layers may weaken the bonding between the toner cores and the shell layers. When the bonding between the toner cores and the shell layers is weak, the shell layers are more easily detachable from the toner cores in response to mechanical stress to the toner. To restrict detachment of the shell layers from the toner cores, the amount of the dispersant is preferably no greater than 75 parts by mass relative to 100 parts by mass of the toner cores.

Examples of the dispersant include sodium polyacrylate, polyparavinyl phenol, partially saponified polyvinyl acetate, isoprene sulfonic acid, polyether, isobutylene-maleic anhydride copolymer, sodium polyaspartate, starch, gelatin-gum arabic, polyvinylpyrrolidone, and sodium lignosulfonate. The dispersants listed above may be used singly or in a combination of two or more.

Subsequently, while the solution of the shell material is stirred, the temperature of the solution is raised to the predetermined polymerization temperature of the shell material (for example, any temperature selected to fall within a range of 50° C. to 85° C.) at a predetermined rate (for example, any rate selected to fall within a range of 0.1° C./minute and to 3° C./minute). Thereafter, while the solution is stirred, the temperature of the solution is maintained at the polymerization temperature of the shell material for a predetermined time period (for example, any time period selected to fall within a range of 30 minutes to 4 hours). This causes the shell material to adhere to the surface of the toner cores and the shell material is cured through a polymerization reaction. As a result, a dispersion of toner mother particles is obtained. Upon polymerization of the shell material, the toner cores contract due to the surface tension, causing the toner cores in a softened state to be spherical.

Consider the case where the toner cores contain a binder resin having a hydroxyl group or a carboxyl group (for example, a polyester resin) and the shell layers are essentially formed from an amino-aldehyde resin. For the shell layer formation to appropriately proceed, the polymerization temperature of the shell material (temperature at which the shell material is polymerized) is preferably at least 40° C. and no greater 95° C., and more preferably at least 50° C. and no greater than 80° C. With the polymerization temperature of the shell material being at least 40° C. and no greater than 95° C., the hydroxyl group or carboxyl group of the toner cores readily reacts with the methylol group of the shell layers, which facilitates formation of the covalent bonds between the toner cores and the shell layers. Consequently, the shell layers can be firmly bonded to the surface of the toner cores.

After the curing of the shell layers in a manner described above, the dispersion of the toner mother particles is neutralized by sodium hydroxide, for example. Subsequently, the dispersion of the toner mother particles is cooled to room temperature, for example. The dispersion of the toner mother particles is then filtered through a Buchner funnel, for example. Through the above, the toner mother particles are separated from the liquid (solid-liquid separation) and a wet cake of the toner mother particles is obtained. The wet cake of the toner mother particles is then washed. To restrict fluctuations in chargeability of the toner due to ambient conditions, the toner mother particles are washed preferably until the electrical conductivity of the filtrate is no greater than 10 μS/cm. The electrical conductivity of the filtrate can be measured by using an electrical conductivity meter (for example, HORIBA ES-51, product of HORIBA, Ltd.). Subsequently, the washed toner mother particles are dried using, for example, a spray dryer, a fluidized bed dryer, a vacuum freeze dryer, or a reduced pressure dryer. Subsequently, the toner mother particles may be mixed with an external additive by using a mixer (for example, FM mixer, product of Nippon Coke & Engineering Co., Ltd.) to cause the external additive to adhere to the surface of the toner mother particles. In the drying process employing a spray dryer, a dispersion of the external additive (for example, silica particles) can be sprayed to carry out both the drying process and the external addition process at the same time. Through the above, a toner including a large number of toner particles is manufactured.

Note that the above-explained method of manufacturing a toner may be altered as appropriate in accordance with desired configuration and characteristics of the toner. For example, the pH of the shell material solvent (for example aqueous medium) may be adjusted either before or after adding the shell material and/or the toner cores to the solvent. Also, the process of adding the toner cores to the solvent may be performed before the process of dissolving the shell material in the solvent or simultaneously with the addition of the shell material to the solvent. Also, the process of heating the solvent to the polymerization temperature of the shell material may be performed before the process of adding the shell material to the solvent. Also, to cause a material (shell material, for example) to react in a solvent, the material may be added to the solvent and then left to react in the solvent for a while, or the material may be added to the solvent over time, causing the material to react in the solvent during the addition. Also, the shell material may be added to the solvent all at a time or in portions. The shell layers may be formed according to any appropriate method. For example, the shell layers may be formed according to an in-situ polymerization method, an in-liquid curing film coating method, or a coacervation method. Also, the toner may be sifted after the process of external addition. Also, non-essential processes may be omitted. When no external additive is caused to adhere to the surface of the toner mother particles (when the external addition process is omitted), the toner mother particles correspond to the toner particles. Neither the material for forming the toner cores (herein referred to as a toner core material) nor the shell material is limited to the specific compounds mentioned above (such as monomer or the like for synthesizing a resin). For example, a derivative of any of the compounds mentioned above may be used as the toner core material or the shell material if necessary. Preferably, a large number of toner particles are formed simultaneously in order to manufacture the toner efficiently.

EXAMPLES

The following explains Examples of the present disclosure. Table 1 shows toners A-1 to A-6, B-1 to B-3, C-1 to C-12, and D-1 to D-8 (each of which is a toner for developing an electrostatic charge image) according to Examples and Comparative Examples.

TABLE 1

| | Toner Core | | Polymerization Conditions | | |
|---|---|---|---|---|---|
| Toner | Triboelectric Charge [μC/g] | Zeta Potential [mV] | pH | Polymerization Reaction | Additive Amount [mL] |
| A-1 | −20 | −15 | 4 | 70° C.-2 Hours | 3.0 |
| A-2 | | | | | 1.0 |
| A-3 | | | | | 6.5 |
| A-4 | | | | | 7.0 |
| A-5 | | | | | 12.0 |
| A-6 | | | — | — | — |
| B-1 | −6 | −6 | 4 | 70° C.-2 Hours | 3.0 |
| B-2 | −4 | −4 | | | 3.0 |
| B-3 | 10 | 20 | | | 2.0 |
| C-1 | −20 | −15 | 3 | 70° C.-2 Hours | 3.0 |
| C-2 | | | 5 | | 3.0 |
| C-3 | | | 3 | | 1.0 |
| C-4 | | | 5 | | 1.0 |
| C-5 | | | 3 | | 6.5 |
| C-6 | | | 5 | | 6.5 |
| C-7 | | | 6 | | 3.0 |
| C-8 | | | 6 | | 1.0 |
| C-9 | | | 6 | | 6.5 |
| C-10 | | | 2 | | 3.0 |
| C-11 | | | 2 | | 1.0 |
| C-12 | | | 2 | | 6.5 |
| D-1 | −20 | −15 | 4 | 70° C.-1 Hour | 3.0 |
| D-2 | | | | 70° C.-3 Hours | 3.0 |
| D-3 | | | | 70° C.-1 Second | 3.0 |
| D-4 | | | | 70° C.-1 Second | 1.0 |
| D-5 | | | | 70° C.-1 Second | 6.5 |
| D-6 | | | | 70° C.-5 Hours | 3.0 |
| D-7 | | | | | 1.0 |
| D-8 | | | | | 6.5 |

The following sequentially explains a manufacturing method, an evaluation method, and evaluation results of the toners A-1 to D-8. Note that evaluation results (values indicating shape and physical properties) of a powder including a plurality of particles (for example, toner cores, toner mother particles, external additive, or toner) are number averages of values measured with respect to an appropriate number of particles, unless otherwise stated. For an evaluation associated with introduction of error, a sufficient number of values for reducing the error to a negligible level were measured, and the arithmetic mean of the thus measured values is used as an evaluation value. In addition, the particle diameter of a powder is an equivalent circle diameter of a primary particle (diameter of a circle with equivalent projected area as the particle) unless otherwise stated. In addition, each volume median diameter ($D_{50}$) is a value measured by using Coulter Counter Multisizer 3 produced by Beckman Coulter, Inc. unless otherwise stated. In addition, each value of roundness is a number average of values measured on 3,000 particles by using a flow particle imaging analyzer (FPIA-3000, product of Sysmex Corporation) unless otherwise stated. In addition, the measurement methods of Tg (glass transition point), Tm (softening point), triboelectric charge, and zeta potential used are as explained below unless otherwise stated.

<Measurement Method of Tg>

A differential scanning calorimeter (DSC-6200, product of Seiko Instruments Inc.) was used to plot a heat absorption curve of a sample (for example, a binder resin or toner cores), and Tg of the sample was determined from a point of change in the heat absorption curve.

<Measurement Method of Tm>

A sample (for example, a binder resin or toner cores) was placed in a capillary rheometer (CFT-500D, product of Shimadzu Corporation) to cause 1 $cm^3$ of the sample to melt flow under the conditions of die diameter of 1 mm, plunger load of 20 $kg/cm^2$, and heating rate of 6° C./minutes. Then, the S-shaped curve (horizontal axis: temperature, and vertical axis: stroke) of the sample was plotted. Subsequently, Tm of the sample was read from the S-shaped curve thus plotted.

<Measurement Method of Triboelectric Charge>

First, 7 parts by mass of a sample (for example, toner cores or toner) was mixed with 100 parts by mass of a standard carrier N-01 (standard carrier for negatively chargeable toner) provided by the Imaging Society of Japan for 30 minutes at a rotational speed of 96 rpm by using a mixer (Turbula (registered Japanese trademark) mixer T2F, product of Willy A. Bachofen AG). Subsequently, the triboelectric charge of the sample upon rubbing with the standard carrier within the resultant mixture can be measured using a Q/m meter (for example, a Model 210HS-2A, product of Trek, Inc.).

<Measurement Method of Zeta Potential>

First, 0.2 g of a sample (for example, toner cores or toner) was mixed with 80 g of ion exchanged water, and 20 g of non-ionic surfactant having a concentration of 1% by mass (K-85, product of Nippon Shokubai Co., Ltd., polyvinylpyrrolidone) by using a magnetic stirrer. Consequently, the sample was homogeneously dispersed in the liquid to obtain a dispersion. Subsequently, the dispersion was adjusted to pH 4 through addition of dilute hydrochloric acid, thereby obtaining the dispersion having pH 4. The zeta potential of the sample in the dispersion adjusted to pH 4 was measured by using a zeta potential and particle size distribution analyzer (DelsaNano HC, product of Beckman Coulter, Inc.).

[Manufacture of Toner A-1]

(Production of Toner Cores A)

A polyester resin was prepared by causing a reaction between para-phthalic acid and an alcohol produced through addition of ethylene oxide to a bisphenol A framework (bisphenol A-ethylene oxide adduct). The resultant polyester resin had a hydroxyl value (measured according to JIS K-0070) of 20 mg KOH/g, an acid value (measured according to JIS K-0070) of 40 mg KOH/g, Tm of 100° C., and Tg of 48° C.

Subsequently, 100 parts by mass of the resultant polyester resin (binder resin) were mixed with 5 parts by mass of a colorant (C.I. Pigment Blue 15:3, phthalocyanine pigment) and 5 parts by mass of a releasing agent (WEP-3, product of NOF Corporation, ester wax) by using a mixer (FM mixer, product of Nippon Coke & Engineering Co., Ltd.). The resultant mixture was then kneaded using a two-screw extruder (PCM-30, product of Ikegai Corp.). Next, the resultant melt-kneaded product was pulverized using a mechanical pulverizer (Turbo Mill, product of Freund-Turbo Corporation) set to a particle diameter of 6 μm. Subsequently, the pulverized product was classified by using a classifier (Elbow Jet, product of Nittetsu Mining Co., Ltd.). As a result, toner cores A having a volume median diameter ($D_{50}$) of 6 μm were obtained.

The toner cores A obtained had a roundness of 0.93, Tg of 49° C., Tm of 90° C., a triboelectric charge of −20 μC/g, and a zeta potential at pH 4 of −15 mV. The measurement results of the triboelectric charge and zeta potential clearly indicate that the toner cores A were anionic.

(Shell Layer Formation)

A three-necked flask having a capacity of 1 L and equipped with a thermometer and a stirring impeller was prepared and set in a water bath. The water bath was used to maintain the internal temperature of the flask at 30° C. Then, the flask was charged with 300 mL of ion exchanged water, followed by addition of 1N-hydrochloric acid to adjust the pH of the aqueous medium (ion exchanged water) contained in the flask (hereinafter, such a pH is referred to as shell-material polymerization pH) to 4.

Subsequently, 3 mL of an aqueous solution of hexamethylol melamine prepolymer (MIRBANE (registered Japanese trademark) resin SM-607, product of Showa Denko K.K.; solid component concentration 80% by mass) was added to the flask, followed by stirring. The resultant hexamethylolated product was then dissolved in the aqueous medium.

Subsequently, 300 g of the toner cores A prepared through the above processes were added to the flask (the acidic aqueous solution in which the shell material was dissolved), and the contents of the flask were sufficiently stirred. Subsequently, 300 mL of ion exchanged water was added to the flask. While the contents of the flask were stirred at a rotational speed of 100 rpm, the internal temperature of the flask was raised to 70° C. at a rate of 1° C./minute. Then, the contents of the flask were stirred for 2 hours at a rotational speed of 100 rpm while the internal temperature was maintained at 70° C. Hereinafter, the temperature (70° C. in the manufacture of the toner A-1) is referred to as a shell-material polymerization temperature, and the time during which the internal temperature of the flask was maintained at the shell-material polymerization temperature (2 hours in the manufacture of the toner A-1) is referred to as a shell-material polymerization time. As a result that the internal temperature of the flask was maintained at the shell-material polymerization temperature for the shell-material polymerization time, shell layers were formed over the surface of the toner cores A to obtain a dispersion of toner mother particles. Subsequently, the dispersion of toner mother particles was cooled to room temperature at a rate of 1° C./minute. Then, an aqueous solution of 1N-sodium hydroxide (neutralizer) was added to the dispersion of toner mother particles, adjusting the resultant solution to pH 7.

Subsequently, the dispersion of toner mother particles obtained through the above processes was filtered (subjected to solid-liquid separation) to isolate the toner mother particles. The resultant toner mother particles were subsequently re-dispersed in ion exchanged water. The toner mother particles were washed by alternately repeating the dispersion and the filtration until the electrical conductivity of the filtrate was 4 μS/cm. The electrical conductivity of the filtrate was measured by using an electrical conductivity meter (for example, HORIBA ES-51, product of HORIBA, Ltd.).

Subsequently, the toner mother particles were dried. After the drying, an external additive was caused to adhere to the toner mother particles. More specifically, 100 parts by mass of the toner mother particles were mixed with 0.5 parts by mass of dry silica fine particles (REA90, product of Nippon Aerosil Co., Ltd.) for 5 minutes, by using an FM mixer (product of Nippon Coke & Engineering Co., Ltd.). As a result, the external additive (silica particles) was caused to adhere to the surface of the toner mother particles. As a result, the toner A-1 was obtained.

[Manufacture of Toner A-2]

A toner A-2 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 1 mL instead of 3 mL.

[Manufacture of Toner A-3]

A toner A-3 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 6.5 mL instead of 3.0 mL.

[Manufacture of Toner A-4]

A toner A-4 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 7 mL instead of 3 mL.

[Manufacture of Toner A-5]

A toner A-5 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 12 mL instead of 3 mL.

[Manufacture of Toner A-6]

A toner A-6 was manufactured through the same processes as the toner A-1, except that no shell layers were formed. In the manufacture of the toner A-6, 100 parts by mass of the toner cores A were mixed with 0.5 parts by mass of dry silica fine particles (REA90, product of Nippon Aerosil Co., Ltd.). As a result, the external additive (silica particles) was caused to adhere to the surface of the toner cores A.

[Manufacture of Toner B-1]

A toner B-1 was manufactured through the same processes as the toner A-1, except that toner cores B were used instead of toner cores A. The toner cores B were manufactured through the same processes as the toner cores A, except for the following.

In the manufacture of the toner cores B, a polyester resin used as the binder resin had a hydroxyl value (measured according to JIS K-0070) of 4 mg KOH/g, an acid value (measured according to JIS K-0070) of 8 mg KOH/g, Tm of 100° C., and Tg of 48° C. In the process of mixing the binder resin, colorant, and releasing agent, 100 parts by mass of the polyester resin (binder resin) explained above was mixed with 5 parts by mass of a colorant (C.I. Pigment Blue 15:3, phthalocyanine pigment) and 5 parts by mass of a releasing agent (WEP-3, product of NOF Corporation, ester wax). Additionally, 1 part by mass of quaternary ammonium salt (BONTRON (registered Japanese trademark) P-51, product of Orient Chemical Industries Co., Ltd.) was mixed.

The toner cores B obtained had a roundness of 0.94, Tg of 49° C., Tm of 90° C., a triboelectric charge of −6 μC/g, and a zeta potential at pH 4 of −6 mV. The toner cores B were slightly anionic.

[Manufacture of Toner B-2]

A toner B-2 was manufactured through the same processes as the toner B-1, except that toner cores C was used instead of toner cores B, which were used in the manufacturer of the toner B-1. The toner cores C were manufactured through the same process as the toner cores B, except that the additive amount of the quaternary ammonium salt (BONTRON P-51, product of Orient Chemical Industries Co., Ltd.) was 0.5 parts by mass instead of 1.0 part by mass.

The toner cores C obtained had a roundness of 0.94, Tg of 49° C., Tm of 90° C., a triboelectric charge of −4 μC/g, and a zeta potential at pH 4 of −4 mV. The toner cores C were slightly anionic.

[Manufacture of Toner B-3]

A toner B-3 was manufactured through the same processes as the toner B-1, except that toner cores D were used instead of the toner cores B and that the additive amount of the aqueous solution of hexamethylol melamine prepolymer (MIRBANE resin SM-607, product of Showa Denko K.K.; solid component concentration 80% by mass) was 2 mL instead of 3 mL. The toner cores D were manufactured through the same processes as the toner cores B, except for the following.

In the manufacture of the toner cores D, the binder resin used was a styrene-acrylic copolymer (monomer composition: styrene/acryl (molar ratio)=80/20) prepared through solution polymerization. The styrene-acrylic copolymer had a hydroxyl value (measured according to JIS K-0070) of 4 mg KOH/g, an acid value (measured according to JIS K-0070) of 2 mg KOH/g, Tm of 100° C., and Tg of 48° C. In addition, the additive amount of the quaternary ammonium salt (BONTRON P-51, product of Orient Chemical Industries, Co., Ltd.) was 2 parts by mass instead of 1 part by mass.

The toner cores D obtained had a roundness of 0.93, Tg of 49° C., Tm of 90° C., a triboelectric charge of +10 μC/g, and a zeta potential at pH 4 of +20 mV. The toner cores D were slightly cationic.

In the manufacture of the toner B-3, the cationic shell material failed to sufficiently adhere to the surface of the toner cores D. As a consequence, aggregates of a hexamethylolated product and the toner cores D were observed during the polymerization reaction of the shell material.

[Manufacture of Toner C-1]

The toner C-1 was manufactured through the same processes as the toner A-1, except that the shell-material polymerization pH was 3 instead of 4.

[Manufacture of Toner C-2]

The toner C-2 was manufactured through the same processes as the toner A-1, except that the shell-material polymerization pH was 5 instead of 4.

[Manufacture of Toner C-3]

The toner C-3 was manufactured through the same processes as the toner A-1, except that the shell-material polymerization pH was 3 instead of 4 and that the additive amount of the aqueous solution of hexamethylol melamine prepolymer (MIRBANE resin SM-607, product of Showa Denko K.K.; solid component concentration 80% by mass) was 1 mL instead of 3 mL.

[Manufacture of Toner C-4]

The toner C-4 was manufactured through the same processes as the toner A-1, except that the shell-material polymerization pH was 5 instead of 4 and that the additive amount of the aqueous solution of hexamethylol melamine prepolymer (MIRBANE resin SM-607, product of Showa Denko K.K.; solid component concentration 80% by mass) was 1 mL instead of 3 mL.

[Manufacture of Toner C-5]

The toner C-5 was manufactured through the same processes as the toner A-1, except that the shell-material polymerization pH was 3 instead of 4 and that the additive amount of the aqueous solution of hexamethylol melamine prepolymer (MIRBANE resin SM-607, product of Showa Denko K.K.; solid component concentration 80% by mass) was 6.5 mL instead of 3.0 mL.

[Manufacture of Toner C-6]

The toner C-6 was manufactured through the same processes as the toner A-1, except that the shell-material polymerization pH was 5 instead of 4 and that the additive amount of the aqueous solution of hexamethylol melamine prepolymer (MIRBANE resin SM-607, product of Showa Denko K.K.; solid component concentration 80% by mass) was 6.5 mL instead of 3.0 mL.

[Manufacture of Toner C-7]

The toner C-7 was manufactured through the same processes as the toner A-1, except that the shell-material polymerization pH was 6 instead of 4.

[Manufacture of Toner C-8]

The toner C-8 was manufactured through the same processes as the toner A-1, except that the shell-material polymerization pH was 6 instead of 4 and that the additive amount of the aqueous solution of hexamethylol melamine prepolymer (MIRBANE resin SM-607, product of Showa Denko K.K.; solid component concentration 80% by mass) was 1 mL instead of 3 mL.

[Manufacture of Toner C-9]

The toner C-9 was manufactured through the same processes as the toner A-1, except that the shell-material polymerization pH was 6 instead of 4 and that the additive amount of the aqueous solution of hexamethylol melamine prepolymer (MIRBANE resin SM-607, product of Showa Denko K.K.; solid component concentration 80% by mass) was 6.5 mL instead of 3.0 mL.

[Manufacture of Toner C-10]

The toner C-10 was manufactured through the same processes as the toner A-1, except that the shell-material polymerization pH was 2 instead of 4.

[Manufacture of Toner C-11]

The toner C-11 was manufactured through the same processes as the toner A-1, except that the shell-material polymerization pH was 2 instead of 4 and that the additive amount of the aqueous solution of hexamethylol melamine prepolymer (MIRBANE resin SM-607, product of Showa Denko K.K.; solid component concentration 80% by mass) was 1 mL instead of 3 mL.

[Manufacture of Toner C-12]

The toner C-12 was manufactured through the same processes as the toner A-1, except that the shell-material polymerization pH was 2 instead of 4 and that the additive amount of the aqueous solution of hexamethylol melamine prepolymer (MIRBANE resin SM-607, product of Showa Denko K.K.; solid component concentration 80% by mass) was 6.5 mL instead of 3.0 mL.

[Manufacture of Toner D-1]

The toner D-1 was manufactured through the same processes as the toner A-1, except that the shell-material polymerization time was 1 hour instead of 2 hours.

[Manufacture of Toner D-2]

The toner D-2 was manufactured through the same processes as the toner A-1, except that the shell-material polymerization time was 3 hours instead of 2 hours.

[Manufacture of Toner D-3]

The toner D-3 was manufactured through the same processes as the toner A-1, except that the shell-material polymerization time was 1 second instead of 2 hours.

[Manufacture of Toner D-4]

A toner D-4 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 1 mL instead of 3 mL and that the shell-material polymerization time was 1 second instead of 2 hours.

[Manufacture of Toner D-5]

A toner D-5 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 6.5 mL instead of 3.0 mL and that the shell-material polymerization time was 1 second instead of 2 hours.

[Manufacture of Toner D-6]

The toner D-6 was manufactured through the same processes as the toner A-1, except that the shell-material polymerization time was 5 hours instead of 2 hours.

[Manufacture of Toner D-7]

A toner D-7 was manufactured through the same processes as the toner A-1, except that the additive amount of an aqueous solution of hexamethylol melamine prepolymer (MIRBANE resin SM-607, product of Showa Denko K.K.; solid component concentration 80% by mass) was 1 mL instead of 3 mL and that the shell-material polymerization time was 5 hours instead of 2 hours.

[Manufacture of Toner D-8]

A toner D-8 was manufactured through the same processes as the toner A-1, except that the additive amount of the aqueous solution of hexamethylol melamine prepolymer (MIRBANE resin SM-607, product of Showa Denko K.K.; solid component concentration 80% by mass) was 6.5 mL instead of 3.0 mL and that the shell-material polymerization time was 5 hours instead of 2 hours.

[Evaluation Method]

The following explains an evaluation method of the samples (toners A-1 to A-6, B-1 to B-3, C-1 to C-12, and D-1 to D-8). Note that the roundness, triboelectric charge, and zeta potential of each sample was measured according to the methods explained above. In addition, occurrence of toner core aggregations during a polymerization reaction of the shell material was visually checked.

(Shell Layer Thickness)

A sample (toner) was sufficiently dispersed in a cold-setting epoxy resin and left to stand for 2 days at an ambient temperature of 40° C. to obtain a hardened material. The hardened material was dyed in osmium tetroxide and subsequently a flake sample of 200 nm in thickness was cut therefrom using a microtome (EM UC6, product of Leica Microsystems) equipped with a diamond knife. Next, a transmission electron microscopy (TEM) image of a cross-section of the flake sample was captured using a transmission electron microscope (JSM-6700F, product of JEOL Ltd.).

The shell layer thickness was measured by analyzing the TEM image by using image analysis software (WinROOF, product of Mitani Corporation). More specifically, on a cross-section of a toner particle, two straight lines were drawn to intersect at right angles at approximately the center of the cross-section. The lengths of four line segments overlapping with the shell layer were measured, thereby measuring thickness of the shell layer at four locations. The shell layer thickness of the toner particle subjected to measurement was determined to be the arithmetic mean of the four lengths that were measured. The shell layer thickness was measured with respect to each of 10 toner particles included in the sample (toner). The arithmetic mean of the 10 measured values was used as an evaluation value.

When the shell layer is excessively thin, the TEM image may not clearly depict a boundary between the toner core and the shell layer, complicating measurement of thickness of the shell layer. In such a situation, the shell layer thickness was measured by using TEM and electron energy loss spectroscopy (EELS) in combination in order to clarify the boundary between the core and the shell layer. More specifically, in the captured TEM image, mapping was performed by EELS for a specific element (for example, nitrogen) contained in the shell layer.

(Shell Layer Hardness)

The shell layer hardness was measured by using an atomic force microscope (AFM). More specifically, the shell layer of a toner particle included in the sample (toner) was pressed with an AFM needle, and the pressing force of the AFM needle at the moment of the shell layer rupturing was determined to be the hardness of the shell layer. The AFM used was a scanning probe microscope (S-image, product of Hitachi High-Tech Science Corporation). The AFM needle used was a silicon cantilever having a low spring constant (OMCL-AC240TS-C3, product of Olympus Corporation, back-reflection coating material: aluminum). The measurement conditions were as follows—Measurement unit: small unit (100 μm), measurement mode: phase mode, measurement region: 1 μm per side (1 μm×1 μm), and resolution: 256 (X data: 256 and Y data: 256).

Prior to the hardness measurement, the sample (toner) was observed by using a scanning electron microscope (SEM) to select, as measurement targets, 10 toner particles having less surface irregularity among the particles included in the sample. For each of 10 measurement target (toner particles) included in the sample, a flat portion of the shell layer surface was designated as a measurement region (1 μm per side), and the shell layer hardness was measured at 10 locations per measurement target (toner particle). Consequently, 100 values were measured per sample (toner). Then, an arithmetic mean of the 100 measured values was determined to be an evaluation value (hardness) of the sample (toner).

(High-Temperature Preservability)

First, 3 g of a sample (toner) was put into a sample bottle having a capacity of 30 mL, and the sample bottle was left to stand for 3 hours in a thermostatic chamber set to 60° C. (DKN602, product of Yamato Scientific Co., Ltd.). Then, the sample bottle was removed from the thermostatic chamber and left to stand for 24 hours at room temperature. Through the above, an evaluation toner was prepared in the sample bottle. Thereafter, the mass of the evaluation toner (hereinafter, referred to as the total mass of the toner) was measured.

Next, a 200-mesh sieve having a known mass was attached to a powder tester (TYPE PT-E 84810, product of Hosokawa Micron Corporation). Then, the evaluation toner was placed on the sieve. Subsequently, the sieve was shaken for 30 seconds at a rheostat level of 5.0 in accordance with a manual of the powder tester. After the sifting, the mass of the toner remaining in the sieve was measured. Then, the aggregation degree of the toner (% by mass) was calculated, in accordance with the expression shown below:

$$\text{Aggregation Degree}=100\times(\text{Mass of Toner Remaining in Sieve})/(\text{Total Mass of Toner})$$

The aggregation degree of a toner was evaluated in accordance with the following criterion.

Very Good: The aggregation degree of the toner was no greater than 15% by mass.

Good: The aggregation degree of the toner was greater than 15% by mass and no greater than 20% by mass.

Poor: The aggregation degree of the toner was greater than 20% by mass.

(Minimum Fixing Temperature)

First, 10 parts by mass of a sample (toner) was mixed with 100 parts by mass of a developer carrier (carrier for FS-05016, product of KYOCERA Document Solutions Inc.) for 30 minutes by using a ball mill to prepare a two-component developer.

A color printer (FS-05250DN, product of KYOCERA Document Solutions Inc., modified to enable adjustment of fixing temperature) was used as an evaluation apparatus. The two-component developer prepared as above was loaded into a developing section of the evaluation apparatus, and the sample (replenishing toner) was loaded into a toner container of the evaluation apparatus.

The evaluation apparatus was used to form a 2 cm×3 cm solid image on a recording medium (Color Copy (registered Japanese trademark) 90, product of Mondi) with a toner application amount of 1.2 mg/cm$^2$. Subsequently, the recording medium having the image formed hereon was passed through a fixing device of the evaluation apparatus at a linear velocity of 195 mm/seconds to fix the solid image onto the recording medium. The fixing temperature of the fixing device was gradually increased from 100° C. to measure the lowest temperature (minimum fixing temperature) at which the solid image (toner image) was duly fixed to the recording medium.

In the measurement of the minimum fixing temperature, whether the toner was fixed at a given temperature or not was determined through a fold-rubbing test as described below. More specifically, the fold-rubbing test was performed by folding a recording medium having a solid image fixed thereon in half such that a surface having the image was folded inwards, and by rubbing a 1 kg weight covered with cloth back and forth on the fold five times. Next, the recording medium was opened up and a fold portion (i.e., a portion to which the solid image was fixed) of the recording medium was observed. The length of toner peeling of the fold portion (peeling length) was measured. The lowest temperature at which the peeling length was no greater than 1 mm was determined to be the minimum fixing temperature. The minimum fixing temperature was evaluated in accordance with the following criterion.

Very Good: The minimum fixing temperature was no greater than 150° C.

Good: The minimum fixing temperature was greater than 150° C. and no greater than 160° C.

Poor: The minimum fixing temperature was greater than 160° C.

(Image Density)

First, 10 parts by mass of a sample (toner) was mixed with 100 parts by mass of a developer carrier (carrier for FS-05016, product of KYOCERA Document Solutions Inc.) for 30 minutes by using a ball mill to prepare a two-component developer.

A color printer (FS-05250DN, product of KYOCERA Document Solutions Inc.) was used as an evaluation apparatus. The two-component developer prepared as above was loaded into a developing section of the evaluation apparatus, and the sample (replenishing toner) was loaded into a toner container of the evaluation apparatus.

The evaluation apparatus was used to perform a print durability test of continuously producing 500 prints of an image having a coverage rate of 5%. The evaluation apparatus was used to form a sample image including a solid portion and a blank portion on a recording medium (evaluation paper) before and after the printing durability test. The image density (ID) of the solid portion of each sample image was measured by using a reflectance densitometer (RD914, product of Sakata Inx Eng. Co., Ltd.). The image density measured was evaluated in accordance with the following criterion.

Good: The image density (ID) was at least 1.1.

Poor: The image density (ID) was less than 1.1.

(Cleanability)

First, 10 parts by mass of a sample (toner) was mixed with 100 parts by mass of a developer carrier (carrier for FS-05016, product of KYOCERA Document Solutions Inc.) for 30 minutes by using a ball mill to prepare a two-component developer.

A color printer (FS-05250DN, product of KYOCERA Document Solutions Inc., cleaning method of the photosensitive member: blade cleaning) was used as an evaluation apparatus. The two-component developer prepared as above was loaded into a developing section of the evaluation apparatus, and the sample (replenishing toner) was loaded into a toner container of the evaluation apparatus.

The evaluation apparatus was used to perform a print durability test of continuously producing 1,000 prints of an image having a coverage rate of 8%. Then, the evaluation apparatus was used to form a sample image on a recording medium (evaluation paper), and the sample image thus formed was visually checked for any image defects resulting from insufficient cleaning of the photosensitive member. In addition, the cleaning blade of the evaluation apparatus was visually checked after the printing durability test for adhesion of toner components. The image cleanability was evaluated in accordance with the following criterion.

Good: Neither image defects nor adhesion of toner components was observed.

Poor: At least either image defects or adhesion of toner components was observed.

[Evaluation Results]

Tables 2 and 3 show evaluation results of the toners A-1 to A-6, B-1 to B-3, C-1 to C-12, and D-1 to D-8.

TABLE 2

| Toner | Shell Layer Thickness [nm] | Shell Layer Hardness [N/m$^2$] | Roundness | Tribo-electric Charge [μC/g] | Zeta Potential [mV] | Aggregation |
|---|---|---|---|---|---|---|
| A-1 | 9.0 | 2.0 | 0.970 | 45 | 30 | No |
| A-2 | 3.0 | 1.5 | 0.973 | 40 | 20 | |
| A-3 | 20.0 | 2.5 | 0.967 | 50 | 35 | |
| A-4 | 22.0 | 2.8 | 0.966 | 55 | 35 | |
| A-5 | 35.0 | 2.9 | 0.965 | 60 | 40 | |
| A-6 | — | — | — | — | — | — |
| B-1 | 9.0 | 2.0 | 0.970 | 35 | 30 | No |
| B-2 | 9.0 | 2.0 | 0.970 | 35 | 15 | No |
| B-3 | 0.1 | 0.5 | 0.980 | 30 | 10 | Yes |
| C-1 | 9.0 | 2.5 | 0.968 | 30 | 30 | No |
| C-2 | 9.0 | 1.7 | 0.972 | 30 | 25 | |
| C-3 | 3.0 | 2.2 | 0.968 | 25 | 20 | |
| C-4 | 3.0 | 1.2 | 0.974 | 25 | 20 | |
| C-5 | 20.0 | 2.9 | 0.966 | 35 | 30 | |
| C-6 | 20.0 | 2.2 | 0.968 | 35 | 30 | |
| C-7 | 9.0 | 0.7 | 0.977 | 30 | 25 | |
| C-8 | 3.0 | 0.6 | 0.977 | 25 | 20 | |
| C-9 | 20.0 | 0.9 | 0.976 | 35 | 30 | |
| C-10 | 9.0 | 3.2 | 0.965 | 30 | 25 | |
| C-11 | 3.0 | 3.0 | 0.966 | 25 | 20 | |
| C-12 | 20.0 | 3.4 | 0.965 | 35 | 30 | |
| D-1 | 9.0 | 1.9 | 0.966 | 30 | 25 | |
| D-2 | 9.0 | 1.4 | 0.974 | 30 | 25 | |
| D-3 | 9.0 | 1.9 | 0.963 | 30 | 25 | |
| D-4 | 3.0 | 1.4 | 0.962 | 25 | 20 | |
| D-5 | 20.0 | 2.4 | 0.964 | 35 | 30 | |
| D-6 | 9.0 | 2.1 | 0.977 | 30 | 25 | |
| D-7 | 3.0 | 1.6 | 0.979 | 25 | 20 | |
| D-8 | 20.0 | 2.6 | 0.975 | 35 | 30 | |

TABLE 3

| | Toner | High-Temperature Preservability [% by mass] | Minimum Fixing Temperature [° C.] | Image Density | Cleanability |
|---|---|---|---|---|---|
| Example 1 | A-1 | 8 | 150 | 1.2 | Good |
| Example 2 | A-2 | 16 | 140 | 1.2 | Good |
| Example 3 | A-3 | 5 | 160 | 1.1 | Good |
| Comparative Example 1 | A-4 | 3 | 170 (Poor) | 1.1 | Good |
| Comparative Example 2 | A-5 | 2 | 180 (Poor) | 1.1 | Good |
| Comparative Example 3 | A-6 | 98 (Poor) | 135 | 0.8 (Poor) | Poor (Adhesion) |
| Example 4 | B-1 | 12 | 135 | 1.2 | Good |
| Example 5 | B-2 | 18 | 135 | 1.2 | Good |
| Comparative Example 4 | B-3 | 98 (Poor) | 180 (Poor) | 1.3 | Poor (Adhesion) |
| Example 6 | C-1 | 20 | 135 | 1.1 | Good |
| Example 7 | C-2 | 12 | 135 | 1.2 | Good |
| Example 8 | C-3 | 18 | 140 | 1.1 | Good |
| Example 9 | C-4 | 5 | 135 | 1.2 | Good |
| Example 10 | C-5 | 20 | 160 | 1.1 | Good |
| Example 11 | C-6 | 20 | 140 | 1.1 | Good |
| Comparative Example 5 | C-7 | 8 | 140 | 1.2 | Poor (Adhesion) |
| Comparative Example 6 | C-8 | 16 | 135 | 1.2 | Poor (Adhesion) |
| Comparative Example 7 | C-9 | 5 | 145 | 1.2 | Poor (Adhesion) |
| Comparative Example 8 | C-10 | 4 | 180 (Poor) | 1.1 | Good |
| Comparative Example 9 | C-11 | 5 | 170 (Poor) | 1.1 | Good |
| Comparative Example 10 | C-12 | 3 | 180 (Poor) | 1.1 | Good |
| Example 12 | D-1 | 3 | 150 | 1.1 | Good |
| Example 13 | D-2 | 3 | 150 | 1.2 | Good |
| Comparative Example 11 | D-3 | 3 | 150 | 1.0 (Poor) | Good |
| Comparative Example 12 | D-4 | 5 | 140 | 0.9 (Poor) | Good |
| Comparative Example 13 | D-5 | 4 | 160 | 1.0 (Poor) | Good |
| Comparative Example 14 | D-6 | 5 | 150 | 1.1 | Poor (Image Defect) |
| Comparative Example 15 | D-7 | 4 | 140 | 1.2 | Poor (Image Defect) |
| Comparative Example 16 | D-8 | 2 | 160 | 1.2 | Poor (Image Defect) |

As shown in Table 2, the toners A-1 to A-3, B-1 to B-2, C-1 to C-6, D-1 to D-2 (toners according to Examples 1 to 13) each satisfied that the zeta potential of the toner cores at pH 4 was less than 0 V (negative value) and the zeta potential of the toner particles at pH 4 was greater than 0 V (positive value). In addition, the shell layer hardness was at least 1 $N/m^2$ and less than 3 $N/m^2$, and the shell layer thickness was no greater than 20 nm. The roundness of the toner particles was at least 0.965 and less than 0.975. As shown in Table 3, the toners according to Examples 1 to 13 were all excellent in high-temperature preservability, minimum fixing temperature, image density, and cleanability.

As shown in Table 3, the toners A-4 and A-5 (toners according to Comparative Examples 1 and 2) were both inferior in minimum fixing temperature. The inferiority of the toners A-4 and A-5 is considered to result from the shell layer thickness exceeding 20 nm (see Table 2).

As shown in Table 3, the toner A-6 (toner according to Comparative Example 3) was inferior in high-temperature preservability, image density, and cleanability. The inferiority of the toner A-6 is considered to result from that no shell layers were formed (see Table 2).

As shown in Table 2, the toner B-3 (toner according to Comparative Example 4) suffered from aggregation of toner cores during the manufacturing process. As shown in Table 3, in addition, the toner B-3 (toner according to Comparative Example 4) was inferior in minimum fixing temperature, high-temperature preservability, and cleanability. The inferiority of the toner B-3 is considered to result from that the zeta potential of the toner cores at pH 4 exceeded 0 V (more specifically, 20 mV), the shell layer hardness was too low (more specifically, less than 1 $N/m^2$), and the roundness of the toner particles was too high (more specifically, at least 0.975) (see Table 2).

As shown in Table 3, the toners C-7 to C-9 (toners according to Comparative Examples 5 to 7) were all inferior in cleanability. The inferiority of the toners C-7 to C-9 is considered to result from that the shell layer hardness was too low (more specifically, less than 1 $N/m^2$) so that stress from the cleaning blade caused adhesion of the toner components (see Table 2).

As shown in Table 3, the toners C-10 to C-12 (toners according to Comparative Examples 8 to 10) were all inferior in minimum fixing temperature. The inferiority of the toners C-10 to C-12 is considered to result from that the shell layer hardness was too high (more specifically, at least 3 $N/m^2$) (see Table 2).

As shown in Table 3, the toners D-3 to D-5 (toners according to Comparative Examples 11 to 13) were all inferior in image density. The inferiority of the toners D-3 to D-5 is considered to result from that the shell layer roundness was too low (more specifically, less than 0.965). Consequently, the adhesion strength of the shell material to the surface of the toner cores increased, thereby decreasing the developability of the toner (see Table 2).

As shown in Table 3, the toners D-6 to D-8 (toners according to Comparative Examples 14 to 16) were all inferior in cleanability. The inferiority of the toners D-6 to D-8 is considered to result from that the shell layer roundness was too high (more specifically, at least 0.975). Consequently, a greater amount of toner particles escaped through a gap between the photosensitive drum and the cleaning blade (see Table 2).

What is claimed is:

1. A capsule toner for developing an electrostatic charge image, comprising a plurality of toner particles each including a core, and a shell layer disposed over a surface of the core, wherein the cores have a zeta potential at pH 4 of less than 0 V, and the toner particles have a zeta potential at pH 4 of greater than 0 V, the shell layers have a hardness of at least 1 $N/m^2$ and less than 3 $N/m^2$ and a thickness of no greater than 20 nm, the toner particles have a roundness of at least 0.965 and less than 0.975, and the core contains a polyester resin through reaction of between para-phthalic acid and a bisphenol A-ethylene oxide adduct.

2. A capsule toner according to claim 1, wherein the shell layers contain a thermosetting resin.

3. A capsule toner according to claim 2, wherein the shell layers contain an aminoaldehyde resin.

4. A capsule toner according to claim 1, wherein the core contains a releasing agent and the shell layer does not contain a releasing agent.

5. A capsule toner according to claim 1, wherein the shell layer does not contain a dispersant.

6. A method of manufacturing a capsule toner for developing an electrostatic charge image, the capsule toner being according to claim 1, the method comprising:

preparing cores;

preparing an aqueous solution in which a shell material is dissolved;

adding the cores and the aqueous solution to an aqueous medium; and forming a shell layer over a surface of each of the cores by causing a polymerization reaction of the shell material in the aqueous medium having a pH of at least 3 and no greater than 5, wherein in the preparing cores, the cores contain a polyester resin through reaction of between para-phthalic acid and a bisphenol A-ethylene oxide adduct.

7. A method according to claim 6, wherein the shell material contains a melamine-formaldehyde initial condensate.

8. A method according to claim 6, wherein in the aqueous medium having a pH of at least 3 and no greater than 5, the cores are anionic and the shell material is cationic.

9. A method according to claim 6, wherein in the preparing cores, the core contains a releasing agent, and in the preparing an aqueous solution, the shell material does not contain a releasing agent.

10. A method according to claim 6, wherein in the preparing an aqueous solution, the shell material does not contain a dispersant.

11. A method according to claim 6, wherein in the adding the cores and the aqueous solution to an aqueous medium, the cores are added to the aqueous medium after the aqueous solution is added to the aqueous medium.

12. A method according to claim 6, wherein in the adding the cores and the aqueous solution to an aqueous medium, the aqueous medium has a pH of at least 3 and no greater than 5.

* * * * *